US007299958B2

(12) United States Patent
Adams et al.

(10) Patent No.: US 7,299,958 B2
(45) Date of Patent: Nov. 27, 2007

(54) STAPLER WITH STACK HEIGHT COMPENSATION

(75) Inventors: David P. Adams, Barrington, IL (US); Kenneth J. Bargo, Chicago, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 11/336,111

(22) Filed: Jan. 20, 2006

(65) Prior Publication Data

US 2006/0163310 A1 Jul. 27, 2006

Related U.S. Application Data

(60) Provisional application No. 60/647,658, filed on Jan. 27, 2005.

(51) Int. Cl.
*B27F 7/17* (2006.01)

(52) U.S. Cl. ..... 227/5; 227/120; 227/130

(58) Field of Classification Search ..... 173/2, 173/5, 6, 7, 109, 120, 131; 227/2, 5, 6, 7, 227/109, 120, 130
See application file for complete search history.

(56) References Cited

U.S. PATENT DOCUMENTS

| | | | | |
|---|---|---|---|---|
| 2,500,217 | A * | 3/1950 | Taylor, Jr. | 227/7 |
| 2,770,805 | A * | 11/1956 | Elzer et al. | 227/7 |
| 2,975,424 | A * | 3/1961 | Oussani | 227/7 |
| 4,199,095 | A | 4/1980 | Yamanoi | |
| 4,720,033 | A | 1/1988 | Olesen | |
| 4,726,505 | A | 2/1988 | Okazaki | |
| 4,844,319 | A | 7/1989 | Kurosawa | |
| 5,007,572 | A | 4/1991 | Chung-Cheng | |
| 5,141,143 | A | 8/1992 | Ebner et al. | |
| 5,222,645 | A | 6/1993 | Sueda | |
| 5,230,457 | A | 7/1993 | Hiroi et al. | |
| 5,346,114 | A | 9/1994 | Udagawa et al. | |
| 5,791,543 | A | 8/1998 | Udagawa et al. | |
| 5,791,544 | A | 8/1998 | Fujimaki | |
| 5,806,750 | A | 9/1998 | Yamanushi et al. | |
| 5,836,502 | A | 11/1998 | Kanai et al. | |
| 6,050,471 | A | 4/2000 | Yagi | |
| 6,068,173 | A * | 5/2000 | Sueda | 227/7 |
| 6,250,531 | B1 | 6/2001 | Yagi | |
| 6,343,785 | B1 | 2/2002 | Yamada et al. | |
| 6,371,352 | B1 | 4/2002 | Mochizuki | |

(Continued)

FOREIGN PATENT DOCUMENTS

| | | |
|---|---|---|
| JP | 9-169006 | 6/1997 |

(Continued)

*Primary Examiner*—Rinaldi I. Rada
*Assistant Examiner*—Lindsay Low
(74) *Attorney, Agent, or Firm*—Michael Best & Friedrich LLP

(57) ABSTRACT

A powered stapler includes a housing and a stapling engine within the housing. The stapling engine includes a staple driving assembly and a rotational drive train operable to actuate the staple driving assembly. A stack height compensation mechanism is integrated with the rotational drive train of the stapling engine and is distinct from any portion of the housing. The stack height compensation mechanism is operable to enable the stapling engine to compensate for varying stack heights of sheets to be stapled by the powered stapler.

13 Claims, 7 Drawing Sheets

U.S. PATENT DOCUMENTS 6,547,119 B2 4/2003 Huang
6,616,029 B1 9/2003 Andersson
6,626,348 B2 9/2003 Kitamura
6,681,975 B2 1/2004 Yamaguchi
6,705,504 B1 3/2004 Kanai et al.
6,820,787 B2 * 11/2004 Pinczewski et al. ..... 227/5
2004/0016789 A1 1/2004 Takada
2004/0134962 A1 7/2004 Mochizuki

FOREIGN PATENT DOCUMENTS

WO WO 03/008160 1/2003

* cited by examiner

STAPLER WITH STACK HEIGHT COMPENSATION

RELATED APPLICATIONS

This application claims priority to U.S. Provisional Patent Application No. 60/647,658 filed Jan. 27, 2005, the entire contents of which are hereby incorporated by reference.

FIELD OF THE INVENTION

The invention relates to staplers, and more particularly to powered staplers.

BACKGROUND OF THE INVENTION

Powered staplers are often designed with features that compensate for the height of the stack of sheets being stapled.

SUMMARY OF THE INVENTION

Some prior art stapler designs place the stack height compensation in or about linkages that are spaced from, yet ultimately driven by the rotational gear or drive train. The present invention provides an improved stack height compensation construction that more closely accompanies, or is integrated with the rotational drive train. In one embodiment, a resilient member directly supports and constrains the movement of a portion of the rotational drive train. This arrangement provides for a simplified and more compact powered stapler.

Other prior art staplers compensate for stack height variation by permitting flexing or resilient deformation of the housing surrounding the stapler engine. In some instances, resilient bushings are directly supported by the housing of the stapler. This makes the compensation inherently difficult to control, and over time, stresses on the housing can degrade the integrity of the housing. The invention provides a stapler engine construction that incorporates stack height compensation completely within the stapler engine, yet without additional linkages. This construction provides a simplified yet robust and durable stapler design in which the stack height compensation is independent of the surrounding housing.

More specifically, the invention provides a powered stapler including a housing and a stapling engine within the housing. The stapling engine includes a staple driving assembly and a rotational drive train operable to actuate the staple driving assembly. A stack height compensation mechanism is integrated with the rotational drive train of the stapling engine and is distinct from any portion of the housing. The stack height compensation mechanism is operable to enable the stapling engine to compensate for varying stack heights of sheets to be stapled by the powered stapler.

In one embodiment, the rotational drive train is at least partially supported by a frame and includes a motor operable to drive a drive member. The drive member is mounted for rotation with a shaft supported by the frame and is configured to engage a driven member of the driving assembly. The ends of the shaft extend through elongated apertures in the frame and are received in resilient members coupled to the frame adjacent the elongated apertures. Together, the resilient members and the elongated apertures allow movement of the shaft and drive member relative to the frame to provide stack height compensation for the stapler.

In particular, the resilient members support the ends of the shaft in a first position with respect to the elongated apertures. However, as the stack height increases, the resilient members permit the ends of the shaft to move away from the first position within the elongated apertures during the stapling operation, and then return the ends of the shaft to the first position when stapling is completed. By permitting the drive shaft to move or float in this manner, excessive loading on the motor is substantially prevented, thereby reducing the occurrence of stapling malfunctions.

In one embodiment, the shaft also supports a drive gear, and the drive member takes the form of one or more cams coupled to the drive gear for rotation with the shaft. The elongated apertures in the frame are arcuate so that movement of the shaft within the elongated arcuate apertures does not allow the drive gear to become disengaged from or even experience any substantial change in the intermeshing relationship with an intermeshed gear.

In another embodiment, the stack height compensation mechanism includes an elongated aperture in the drive gear that supports a resilient member. The cams coupled to the drive gear are mounted on a shaft that extends through the resilient member and the aperture in the drive gear such that the cams can move radially, as constrained by the resilient member and the aperture, in relation to the drive gear to compensate for varying stack heights.

Other features and advantages of the invention will become apparent to those skilled in the art upon review of the following detailed description and drawings.

Figure 1:
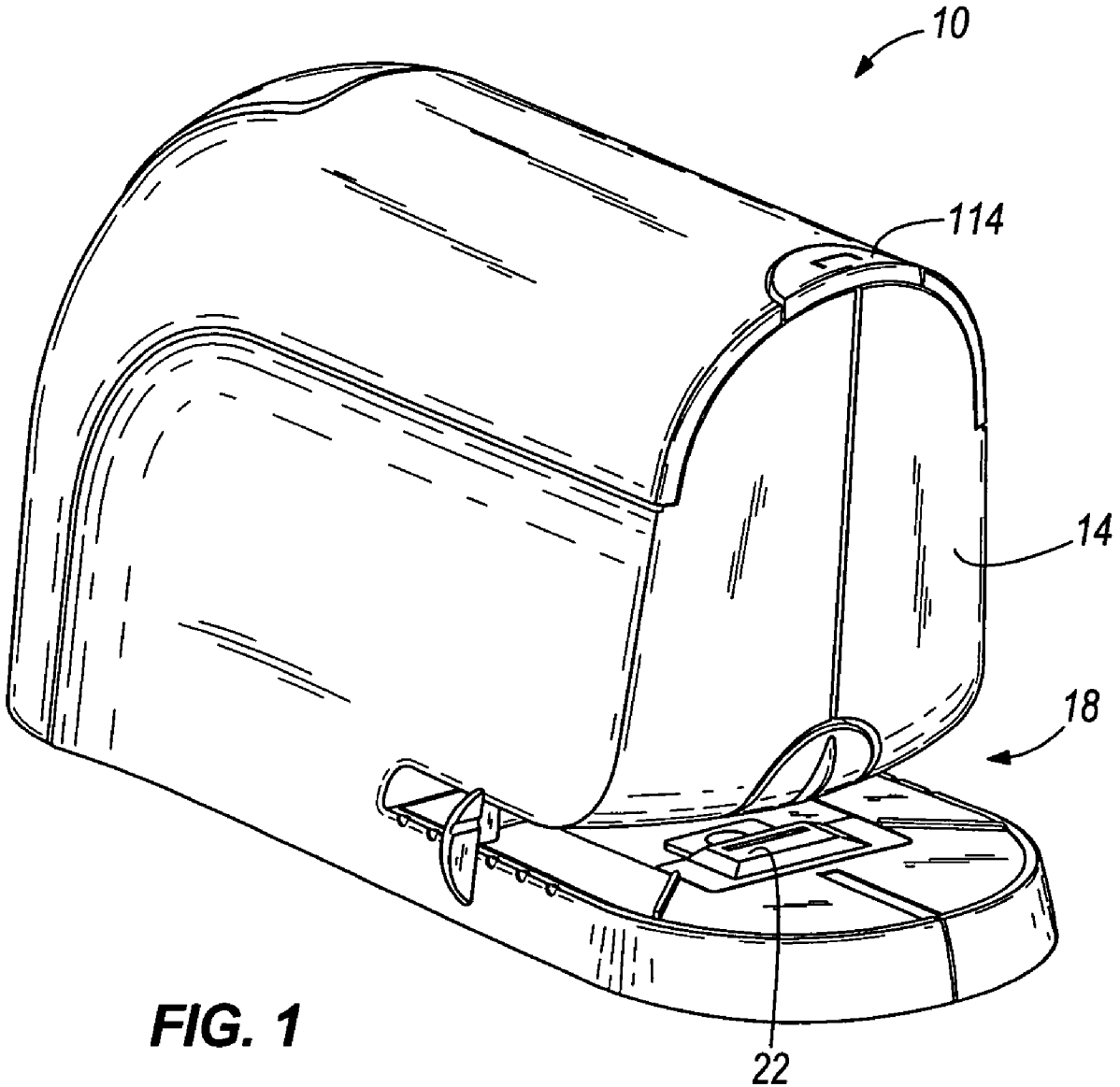
FIG. 1 is a perspective view of a stapler embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION

FIGS. 1-12 illustrate a stapler 10 embodying the present invention. The stapler 10 is a powered or electric stapler operable with an AC to DC current supply, a DC current supply, or both. With reference to FIG. 1, the stapler 10 includes a housing 14 defining a slot 18 configured to receive a stack of sheets S (see FIGS. 7, 9, and 11) to be stapled. An anvil 22 is supported by the housing 14 in a location opposite to the staple ejection point. The anvil 22 receives the legs of the staples driven through the stack of sheets S and clinches the legs in a known manner.

Figure 2:
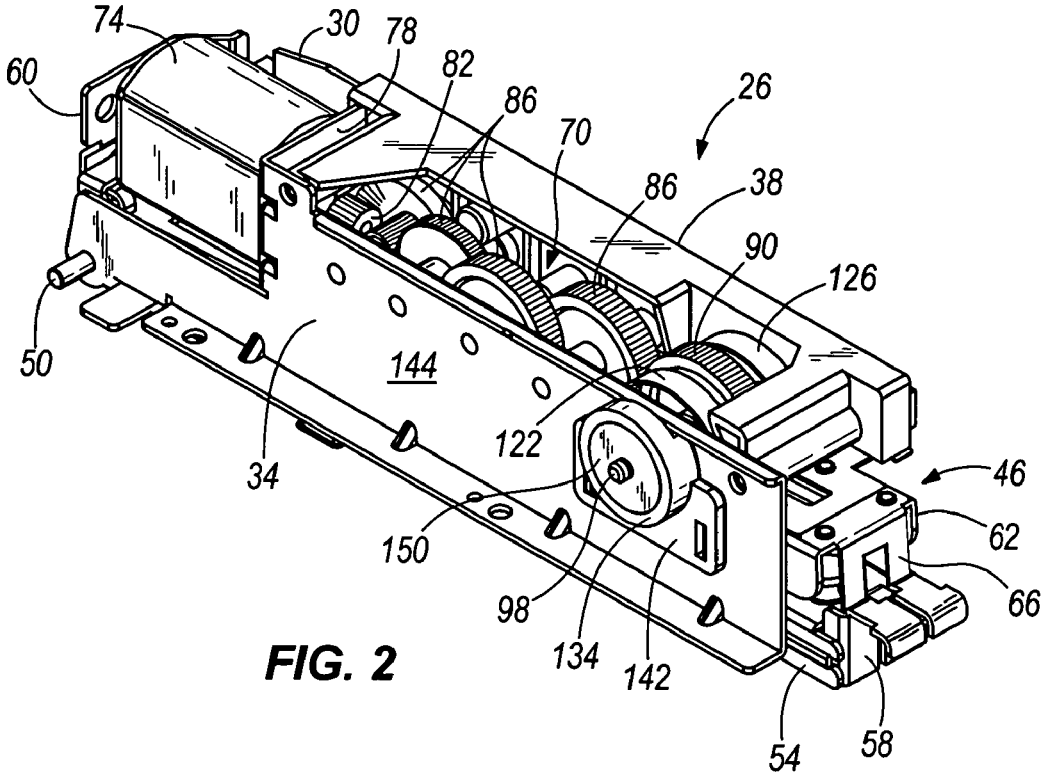
FIG. 2 is a right-side perspective view, taken from the front, of the engine of the stapler shown in FIG. 1.
Figure 3:
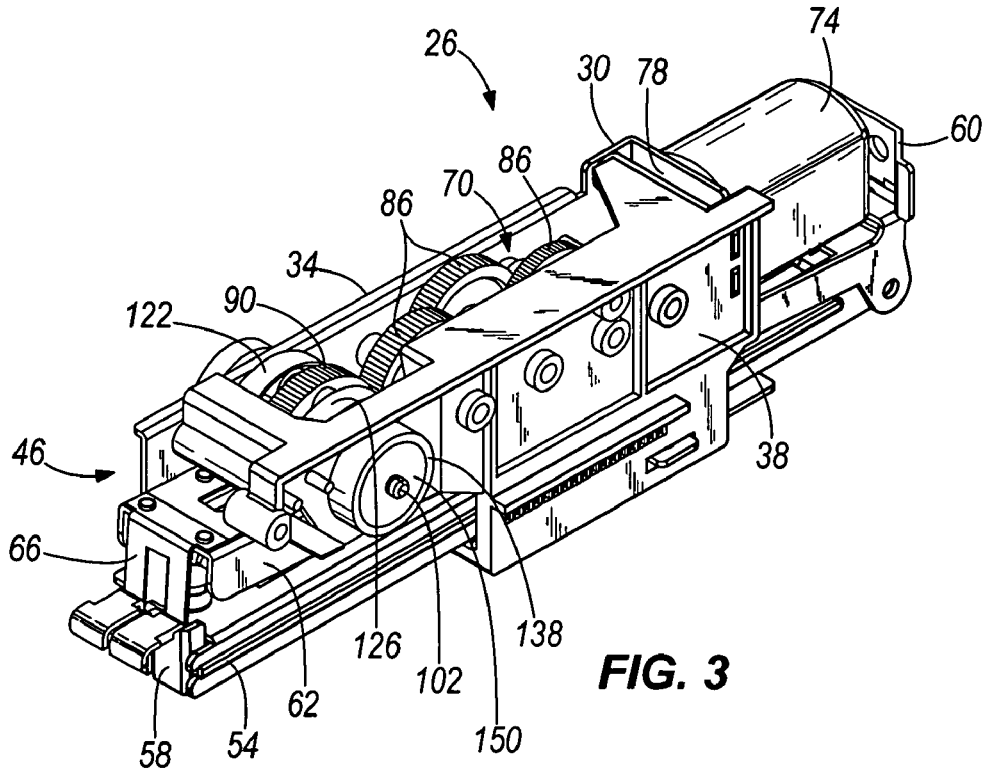
FIG. 3 is a left-side perspective view, taken from the front, of the engine of the stapler shown in FIG. 1.
Figure 4:
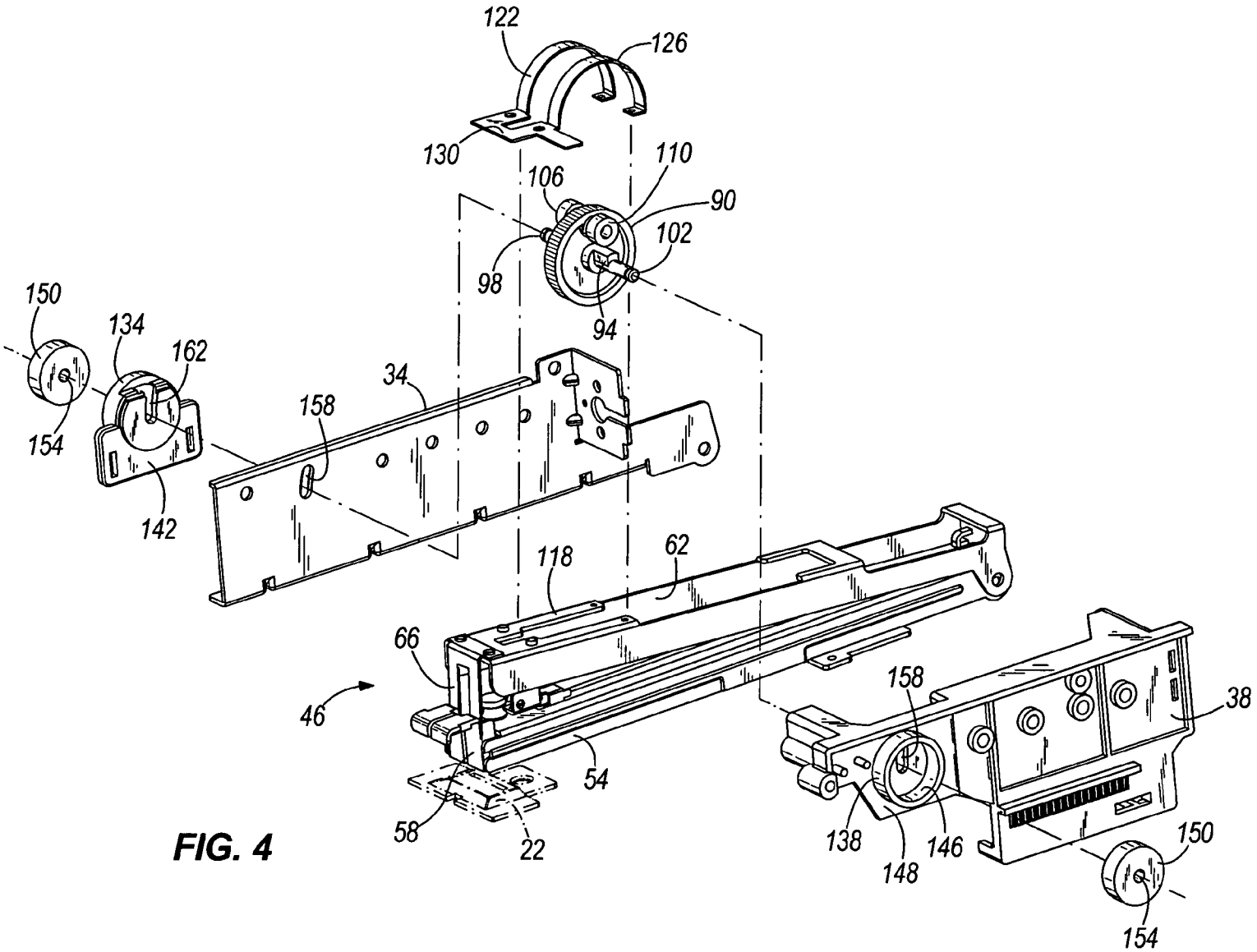
FIG. 4 is a partially exploded view of the stapler engine, shown with various components removed for clarity.

Referring now to FIGS. 2-4, the stapler 10 includes a stapler engine 26 housed within the housing 14. The stapler engine 26 is a generally self-contained unit having a frame 30 including first and second gear box plates 34 and 38, respectively. The gear box plates 34, 38 are fixedly mounted within the housing 14.

The stapler engine 26 further includes a staple driving assembly 46 positioned between the gear box plates 34, 38 and pivotally mounted on pivot shaft 50 (see FIG. 2) such that the staple driving assembly 46 can pivot toward and away from the anvil 22 for stapling. The staple driving assembly 46 includes a magazine 54 that houses staples. The front end 58 of the magazine 54 defines a staple ejection point. A staple release lever 60 (see FIGS. 2, 3, and 5) is operable to release the magazine 54 from its illustrated position to an extended position (not shown) where the magazine 54 extends from the front of the housing 14 for staple refilling.

The staple driving assembly 46 further includes a rail 62 that is pivotally mounted on the pivot shaft 50 for pivotal movement relative to the frame, but that is also pivotable relative to the magazine 54. A staple driver blade 66 is mounted on the front of the rail 62 and is positioned adjacent the front end 58 of the magazine 54, such that pivoting of the rail 62 causes the driver blade 66 to enter the front end 58 of the magazine 54 adjacent the crown of a staple to be driven. As the rail 62 pivots, engagement between the rail 62 and the magazine 54 causes the magazine 54 to pivot with the rail 62 until the bottom of the magazine 54 engages the stack of sheets S and is substantially prevented from rotating further. Continued pivoting of the rail 62 with respect to the magazine 54 causes the driver blade 66 to drive the staple from the magazine 54 and into a stack of sheets S.

The stapler engine 26 also includes a rotational drive train 70 supported by the frame 30 for actuating the staple driving assembly 46. With continued reference to FIGS. 2 and 3, the rotational drive train 70 includes an electric motor 74 coupled to a rear wall portion 78 of the first gear box plate 34. The motor 74 includes an output pinion gear 82 that drives a plurality of intermediate gears 86 in the drive train 70. The plurality of intermediate gears 86 are mounted on respective gear shafts (not shown) that are supported for rotation at opposite ends by the first and second gear box plates 34, 38. The last gear of the rotational drive train 70, which will be referred to as the drive gear or cam gear 90, is best shown in FIG. 4. The drive gear 90 rotates with a central shaft 94 having first and second ends 98, 102, respectively.

As best seen in FIG. 4, the drive gear 90 supports a drive member in the form of first and second cams 106, 110, respectively, that rotate with the drive gear 90. In the illustrated embodiment, the cams 106, 110 are cylindrical members rotatably mounted on a shaft 112 (see FIG. 5) extending through the drive gear 90 at a radial distance from the central shaft 94. The cams 106, 110 can be made of any suitable material, and in the illustrated embodiment, are made of plastic (e.g., NYLON).

The rotational drive train 70 operates as follows to actuate the staple driving assembly 46. First, an input signal, which signals that a stapling action is desired, is received by the motor 74. Such a signal can originate from a push button 114 (see FIG. 1) actuated by the user, or from a switch or sensor (not shown) positioned in the slot 18 that senses the insertion of a stack of sheets S for stapling. The motor 74 is energized, causing rotation of the pinion gear 82. Rotation of the pinion gear 82 causes the rotation of the intermeshed intermediate gears 86. The intermediate gear 86 that is intermeshed with the drive gear 90 causes the rotation of the drive gear 90. As used herein and in the appended claims, the term "rotational drive train" is used to refer to the components that convert the rotational output of the motor to linear motion that can be input to the driven member, which in the illustrated embodiment is the rail 62.

Figure 5:
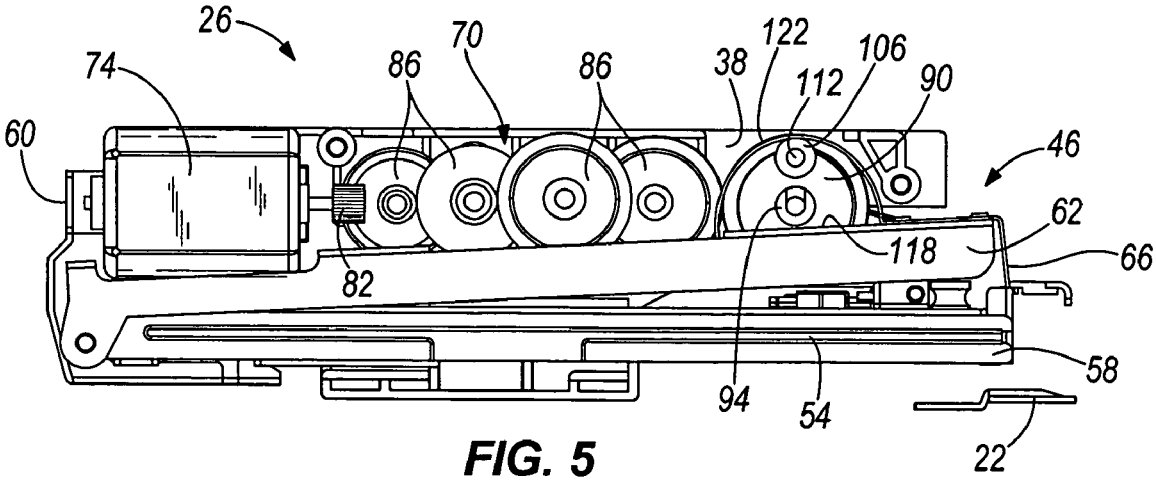
FIG. 5 is a right side view of the stapler engine, shown in its home position with a portion of the frame and a corresponding bushing removed for clarity.
Figure 7:
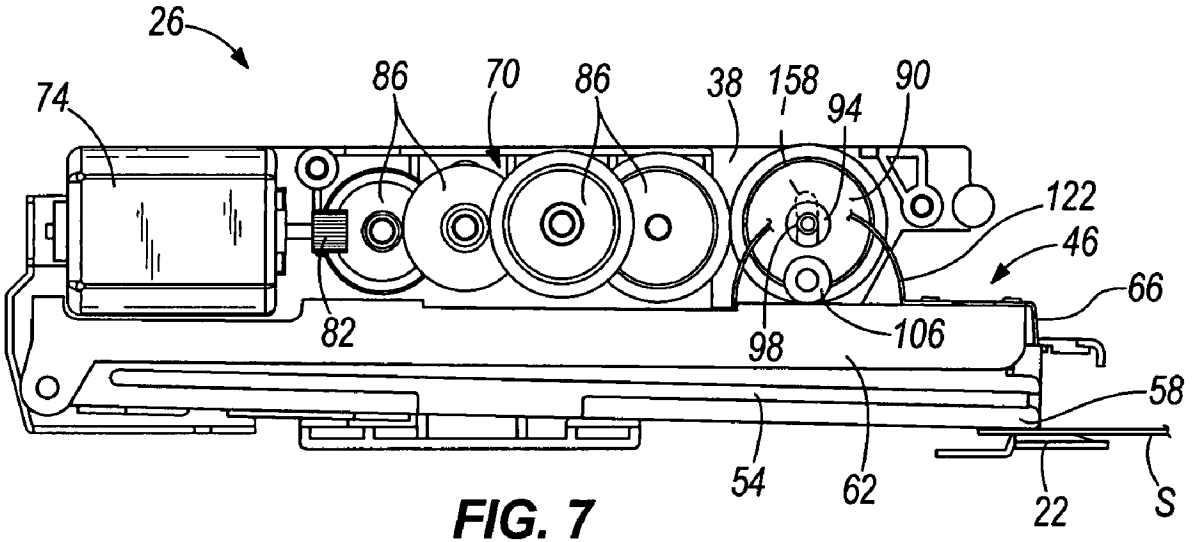
FIG. 7 is a right side view similar to FIG. 5, showing the position of the engine components during the stapling of a small stack of sheets.
Figure 9:
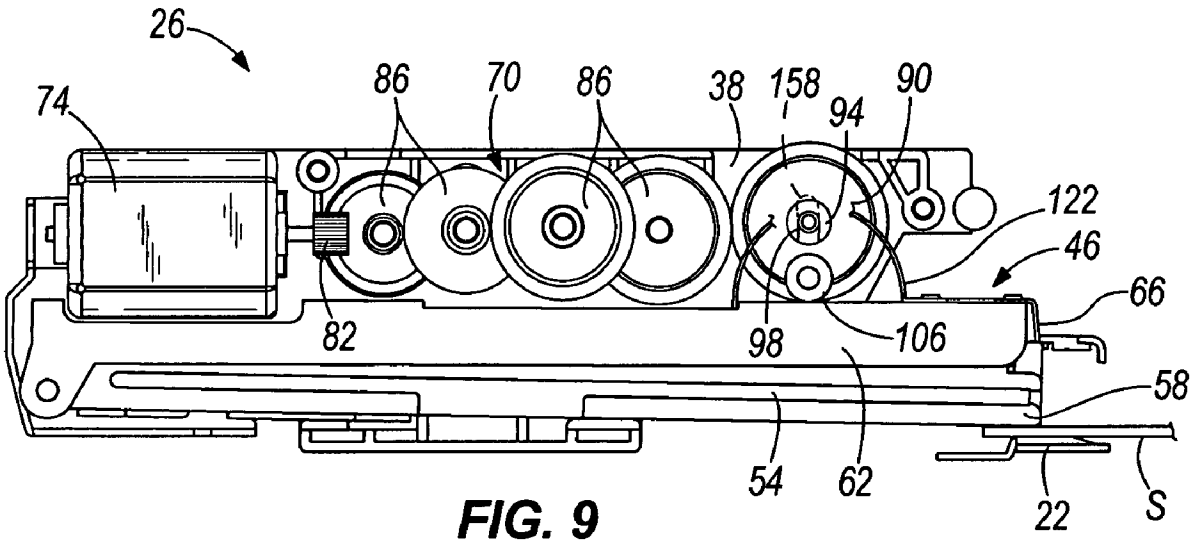
FIG. 9 is a right side view similar to FIG. 5, showing the position of the engine components during the stapling of a medium-sized stack of sheets.
Figure 11:
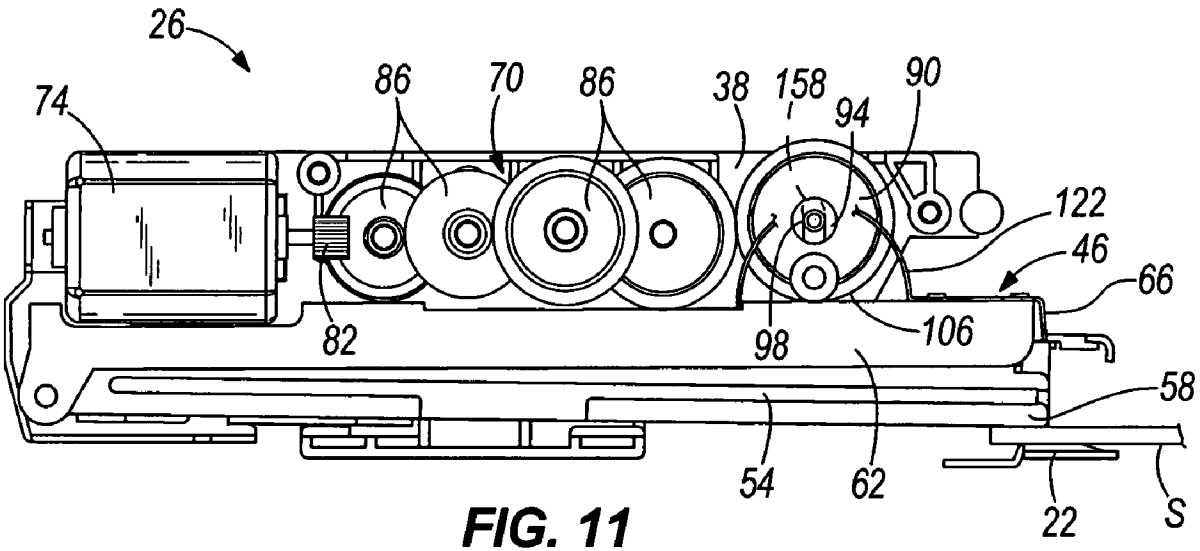
FIG. 11 is a right side view similar to FIG. 5, showing the position of the engine components during the stapling of a large stack of sheets.

FIG. 5 illustrates the staple driving assembly 46 and the drive gear 90 in the home position, where the cams 106, 110 are positioned at the top-dead-center location with respect to the drive gear 90. As the drive gear 90 rotates (in the clockwise direction with respect to FIG. 5), the cams 106, 110 rotate until they engage a top surface 118 of the rail 62. The continued rotation of the drive gear 90 causes the cams 106, 110 to drive the rail 62 downwardly for stapling, as previously described above. FIGS. 7, 9, and 11 illustrate the cams 106, 110 at the bottom-dead-center location with respect to the drive gear 90. Staple driving is completed when the cams 106, 110 reach this position.

Continued rotation of the drive gear 90 causes the cams 106, 110 to engage respective cam follower portions 122, 126 of a cam follower member 130 (see FIG. 4) that is mounted on the top surface 118 of the rail 62. As the cams 106, 110 continue to rotate toward the top-dead-center location, the engagement between the cams 106, 110 and the respective cam follower portions 122, 126 causes the rail 62 and the magazine 54 to pivot upwardly and away from the anvil 22. When the cams substantially reach the top-dead-center position, rotation of the drive gear 90 ceases until the next energizing of the motor 74.

The stapler engine 26 of the present invention is further equipped to compensate for the varying stack height of the stack of sheets S being stapled. Referring again to FIG. 4, the first and second gear box plates 34, 38 each include a respective bushing block 134, 138 positioned adjacent the location where the ends 98, 102 of the central gear's drive shaft 94 are supported. In the illustrated embodiment, the bushing block 134 of the first gear box plate 34 is formed on a separate bushing block member 142 attached to the outer surface 144 (see FIG. 2) of the first gear box plate 34. The bushing block 138 of the second gear box plate 38 is integrally formed on the outer surface 148 (see FIG. 4) of the second gear box plate 38. In alternative embodiments, both bushing blocks 134, 138 could be integral with or separately attached to the respective gear box plates 34, 38.

The bushing blocks 134, 138 each define a recess 146 (see FIGS. 4 and 6) configured to receive a resilient bushing member 150. In the illustrated embodiment, the resilient bushing members 150 are made of an elastomeric material, such as polyurethane, but could be made of other suitable materials as well. Each resilient bushing member 150 includes an aperture 154 (see FIG. 4) sized to snugly receive one of the ends 98, 102 of the drive shaft 94, as will be discussed in greater detail below. While the recesses 146 and the bushings 150 are illustrated as being generally cylindrical in shape, other suitable configurations can be substituted. Additionally, the size of the bushings 150 can be varied as desired depending on the material used. In the illustrated embodiment, the diameter of the bushing is at least twice as large as the height of the number of sheets defining the stapler's sheet capacity. In yet other embodiments, the resilient bushing members 150 can be replaced by suitable resilient members of differing constructions capable of movably supporting the ends 98, 102 of the drive shaft 94 in the manner described below.

Figure 6:
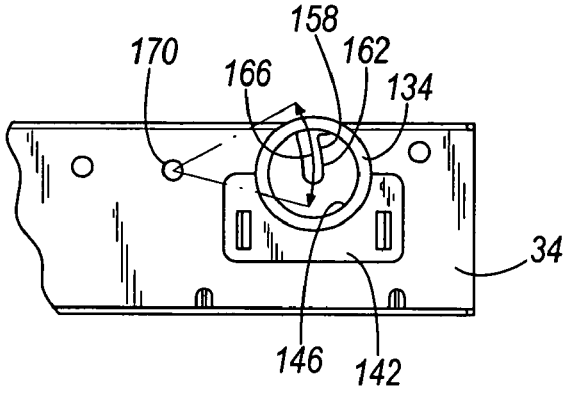
FIG. 6 is a partial right side view of a portion of the frame removed from the stapler engine, showing a support bushing block having an elongated, arcuate aperture.

As best illustrated in FIGS. 4 and 6, the bushing blocks 134, 138 are coupled to the respective gear box plates 34, 38 such that each recess 146 is in communication with a respective arcuate, elongated slot or channel 158 formed in each gear box plate 34, 38. As shown in FIG. 4, the separate bushing block member 142 also includes an arcuate elongated slot 162 substantially similar in shape to the slot 158 formed in the first gear box plate 34. The slots 158, 162 are configured to receive the respective ends 98, 102 of the drive shaft 94, and to allow the ends 98, 102 to be received in the respective apertures 154 in the resilient bushings 150 positioned in the bushing blocks 134, 138. The drive shaft 94 is thereby normally supported by the resilient bushing members 150 in the bushing blocks 134, 138 in a first position with respect to the slots 158, the first position being determined by the location of the apertures 154 in the resilient bushing members 150. However, as will be described below, the drive shaft 94 is free to move or float to other positions within the slots 158 to compensate for varying stack heights of the sheets S to be stapled.

The stack height compensation will now be described with reference to FIGS. 6-12. FIG. 6 illustrates the slot 162 in the bushing block member 142 and the underlying slot 158 in the first gear box plate 34. The slots 158 and 162 are illustrated as having a generally constant radius of curvature (indicated generally by the arrow 166) taken from the center of apertures 170 (only one is shown in FIG. 6) where the forward-most intermediate gear 86 is mounted in the gear box plates 34, 38. This is significant in that the forward-most intermediate gear 86 will not lose driving contact with the drive gear 90 or even experience substantially any change in the intermeshing relationship with the drive gear 90 as a result of movement of the drive shaft 94 within the slots 158, 162. Rather, because the slots 158 and 162 are configured with a generally constant radius of curvature about the apertures 170, the forward-most intermediate gear 86 and the drive gear 90 will maintain a constant center-to-center distance regardless of the positioning of the drive shaft 94 within the slots 158, 162. This results in a substantially unchanged intermeshing engagement between the drive gear 90 and the intermediate gear 86 regardless of the stack height of the sheets being stapled.

FIG. 7 illustrates the positioning of the stapler engine components during the stapling of a small stack of sheets S (e.g., 2-5 sheets). As described above, the magazine 54 and rail 62 are driven downwardly by the cams 106, 110 until the magazine 54 first engages the stack of sheets S supported on the anvil 22. Upon continued downward movement of the rail 62 with respect to the magazine 54, the driver blade 66 drives a staple into the stack of sheets S. The small stack height of the sheets S allows the magazine 54 to pivot downwardly almost all of the way to the anvil 22. With the magazine 54 pivoted this far, the travel of the cams 106, 110 to the bottom-dead-center location on the drive gear 90 occurs without a significant resistive force in addition to the resistive force created by the staple driving action itself. Because there is little or no additional resistive force exerted on the cams 106, 110 due to this minimal stack height, the loading on the motor 74 is not unduly high.

Figure 8:
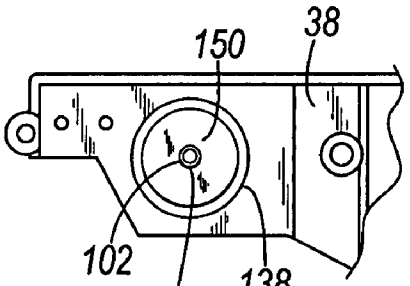
FIG. 8 is a partial left side view of the stapler engine as shown in FIG. 7, showing the positioning of the drive shaft within a support bushing.

As shown in FIG. 7, the drive shaft 94 remains positioned in the lower end of the slot 158 (shown in dashed lines in FIG. 7) in the second gear box plate 38. This position will be referred to generally as the first position. FIG. 8 illustrates the positioning of the end 102 of the drive shaft 94 within the resilient bushing 150 and within the bushing block 138. The aperture 154 in the bushing 150 maintains the drive shaft 94 in the lower end of the slot 158 during the stapling of a small stack of sheets. While not shown, the bushing 150 supporting the opposite end 98 of the drive shaft 94 would appear as a substantial mirror image of the bushing 150 shown in FIG. 8.

Figure 10:
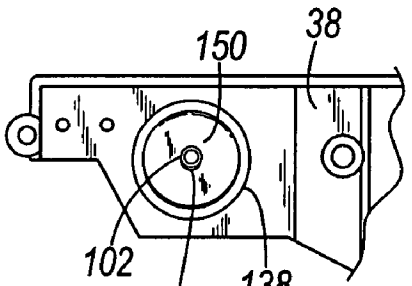
FIG. 10 is a partial left side view of the stapler engine as shown in FIG. 9, showing the positioning of the drive shaft within the support bushing.

FIGS. 9 and 10 illustrate the positioning of the stapler engine components during the stapling of a medium-sized stack of sheets S (e.g., 10-15 sheets). As shown in FIG. 9, the magazine 54 engages the stack of sheets S at a distance further from the anvil 22, meaning that the magazine 54 cannot pivot downwardly as far as it does in FIG. 7. Because the magazine pivots less, the rail 62 will also pivot less. Without some form of compensation for this larger stack height, the motor 74 would be more heavily loaded due to the resistive force exerted by the rail 62 on the cams 106, 110 as the cams attempt to rotate to the bottom-dead-center position. This heavier load upon the motor 74 could potentially result in stapling malfunctions.

To accommodate this larger stack height, the added resistive force exerted on the cams 106, 110 during the sheet clamping and stapling process causes the drive shaft 94 to move upwardly in the slots 158, 162 to the position illustrated in FIG. 9 (note the decreased distance between the top of the slot 158 and the top of the drive shaft 94 as compared to FIG. 7). This results in the entire drive gear 90 moving upwardly and slightly rearwardly along the arcuate path defined by the curvature of the slots 158, 162 (note the increased amount of the drive gear 90 extending above the top edge of the gear box plate 38 as compared to FIG. 7). As described above, the drive gear 90 remains in engagement with the forward-most intermediate gear 86 such that the stapling action continues without interruption. By moving the drive gear 90 generally upwardly in this manner, the bottom-dead-center position of the cams 106, 110 is slightly higher than that same position shown in FIG. 7. By raising the bottom-dead-center position of the cams 106, 110, the added resistive force on the cams 106, 110 caused by the larger stack height is substantially neutralized.

FIG. 10 illustrates the positioning of the end 102 of the drive shaft 94 within the resilient bushing 150 and within the bushing block 138 during the stapling of the medium-sized stack of sheets shown in FIG. 9. Because the end 102 of the drive shaft 94 has moved upwardly in the slot 158, the resilient bushing 150 is temporarily deformed generally as illustrated in FIG. 10. Of course, the actual deformation may vary depending upon the particular make-up and configuration of the resilient bushings 150 and depending upon the number and thicknesses of the sheets S in the stack. The top of the bushing 150 is compressed against the top of the bushing block 38 while a slight clearance may be formed between the bottom of the bushing 150 and the bottom of the bushing block 38. The upward movement of the end 102 of the drive shaft 94 may temporarily elongate the aperture 154 in the bushing 150 as shown. While not shown, the bushing 150 supporting the opposite end 98 of the drive shaft 94 would appear as a substantial mirror image of the bushing 150 shown in FIG. 10.

After stapling is completed, and once the cams 106, 110 begin to rotate back toward the top-dead-center position, the resistive force that moved the shaft 94 upwards in the slots 158 and against the urging of the bushings 150 is reduced or eliminated. Therefore, the resilient bushings 150 urge the shaft 94 back toward the first position within the slots 158 (the position generally illustrated in FIG. 7).

Figure 12:
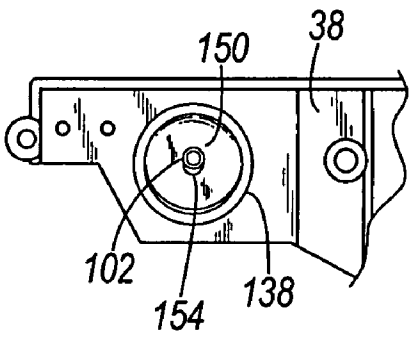
FIG. 12 is a partial left side view of the stapler engine as shown in FIG. 11, showing the positioning of the drive shaft within the support bushing.

FIGS. 11 and 12 illustrate the positioning of the stapler engine components during the stapling of a large stack of sheets S (e.g., 20-25 sheets). As shown in FIG. 11, the magazine 54 engages the stack of sheets S at a distance even further from the anvil 22, meaning that the magazine 54 cannot pivot downwardly as far as it does in FIG. 9. To accommodate this larger stack height, the added resistive force exerted on the cams 106, 110 during the sheet clamping and stapling process causes the drive shaft 94 to move upwardly even further in the slots 158, 162 to the position illustrated in FIG. 11 (note the decreased distance between the top of the slot 158 and the top of the drive shaft 94 as compared to FIG. 9). Again, the entire drive gear 90 moves upwardly and slightly rearwardly along the arcuate path defined by the curvature of the slots 158, 162 so that the drive gear 90 remains in engagement with the forward-most intermediate gear 86 (note the increased amount of the drive gear 90 extending above the top edge of the gear box plate 38 as compared to FIG. 9). By moving the drive gear 90 generally upwardly in this manner, the bottom-dead-center position of the cams 106, 110 is even higher than that same position shown in FIG. 9. Again, by raising the bottom-dead-center position of the cams 106, 110, the added resistive force on the cams 106, 110 caused by the large stack height is substantially neutralized.

FIG. 12 illustrates the positioning of the end 102 of the drive shaft 94 within the resilient bushing 150 and within the bushing block 138 during the stapling of the large stack of sheets shown in FIG. 11. Because the end 102 of the drive shaft 94 has moved upwardly in the slot 158, the resilient bushing 150 is temporarily deformed generally as illustrated in FIG. 12. Of course, the actual deformation may vary depending upon the particular make-up and configuration of the resilient bushings 150 and depending upon the number and thicknesses of the sheets S in the stack. The top of the bushing 150 is compressed against the top of the bushing block 38 even more than as shown in FIG. 10 for a medium-sized stack S, while a slightly larger clearance than that shown in FIG. 10 may be formed between the bottom of the bushing 150 and the bottom of the bushing block 38. The upward movement of the end 102 of the drive shaft 94 temporarily elongates the aperture 154 in the bushing 150 even further than shown in FIG. 10. While not shown, the bushing 150 supporting the opposite end 98 of the drive shaft 94 would appear as a substantial mirror image of the bushing 150 shown in FIG. 12.

After stapling is completed, and once the cams 106, 110 begin to rotate back toward the top-dead-center position, the resistive force that moved the shaft 94 upwards in the slots 158 and against the urging of the bushings 150 is reduced or eliminated. Therefore, the resilient bushings 150 urge the shaft 94 back toward the first position within the slots 158 (the position generally illustrated in FIG. 7).

Note that the different positions of the shaft 94 within the slots 158, as represented in FIGS. 7, 9, and 11, are illustrative only and do not necessarily represent the precise position of the shaft 94 for the exemplary stack height ranges listed. Rather, the ability of the shaft 94 to float within the slots 158 will depend on the construction and make-up of the bushings 150, as well as on the actual stack height of the sheets S. When the stapler 10 is in the home position illustrated in FIGS. 2, 3, and 5, the apertures 154 in the bushings 150 will position the shaft 94 in the first position with respect to the slots 158. As illustrated in FIG. 7, the stapling of a small stack of sheets S may not cause the shaft 94 to move substantially from the first position, however, as the stack height increases, the shaft 94 will tend to move further and further away from the first position during stapling.

By incorporating the stack height compensation feature as part of the rotational drive train 70 (as opposed to somewhere downstream of the rotational drive train where the rotational output of the motor has already been converted to linear motion for driving the driven member of the staple driving assembly), no intermediate linkages are required between the rotational drive train 70 and the staple driving assembly 46 for stack height compensation. This provides for a more compact powered stapler design. Furthermore, by incorporating the stack height compensation completely within the stapler engine 26, including the frame 30, and not in or directly supported by the housing 14, substantially no stresses or strains associated with stack height compensation can jeopardize the structural integrity of the housing 14. Additionally, the use of the resilient bushings 150 and the elongated slots 158, 162 provide a reliable and cost-effective design for accommodating stack height variation.

Figure 13:
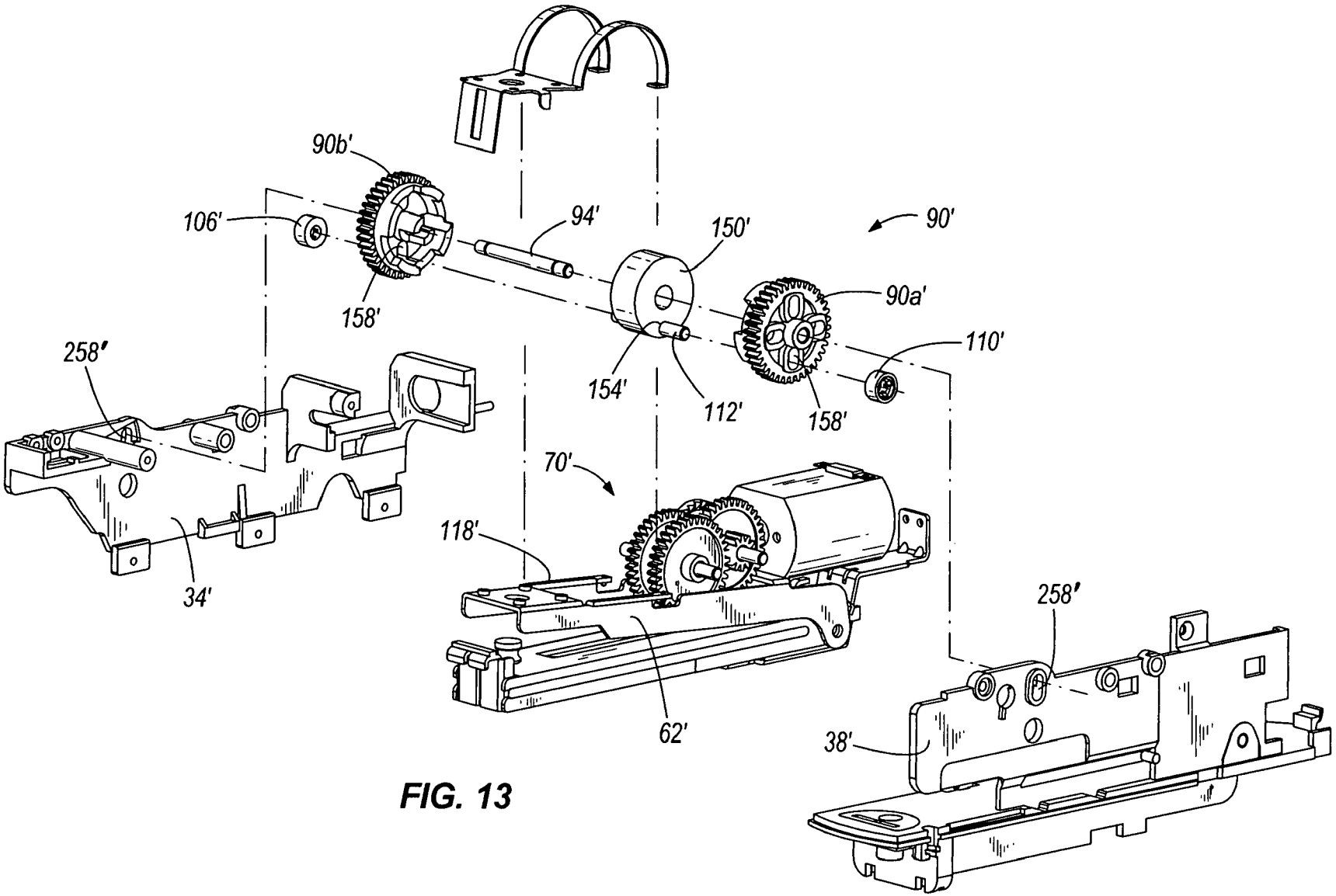
FIG. 13 is a partially exploded view of a stapler engine incorporating a second embodiment of a stack height compensation system of the invention.

FIG. 13 illustrates a second embodiment of a stack height compensation system of the invention, which also integrates the stack height compensation with the rotational drive train of the stapler engine. Similar parts in this embodiment are given like reference numbers designated as prime (').

In the embodiment of FIG. 13, a single resilient member 150' and the slots 158' are moved further downstream in the rotational drive train 70', yet remain integrated with the rotational drive train 70'. Specifically, as shown in FIG. 13, the drive gear 90' is formed in two halves **90*a*' and 90*b*'. Each half includes an elongated slot 158' extending therethrough. The cams 106', 110' are mounted on a shaft 112' received in and that extends through the slots 158' in the gear halves 90*a*', 90*b*' and through an aperture 154' in a resilient member 150' sandwiched between the gear halves 90*a*', 90*b*'. With this construction, the cams 106', 110' are free to float and move radially with respect to the drive gear 90', as constrained by the slots 158' and the resilient member 150', in substantially the same manner as discussed above with respect to the movement of the shaft 94 within the slots 158 and resilient members 150. This allows the cams 106', 110' to move relative to the top surface 118' of the rail 62' during stapling operations to compensate for varying stack heights. Note also that the shaft 94' is still retained and movable in elongated, arcuate slots 258' formed in the first and second gear box plates 34', 38'**.

Various features of the invention are set forth in the following claims.

The invention claimed is:

1. A powered stapler comprising:

a housing;

a stapling engine within the housing, the stapling engine including a staple driving assembly and a rotational drive train operable to actuate the staple driving assembly, the rotational drive train including a first gear mounted for rotation on a shaft having opposite ends;

a frame at least partially supporting the rotational drive train and including arcuate apertures configured to receive the opposite ends of the shaft and allow the shaft to move along an arcuate path relative to the frame such that the gear on the shaft will remain in a substantially unchanged intermeshing relation with a second gear of the drive train regardless of any movement of the shaft within the apertures in the frame; and a stack height compensation mechanism integrated with at least one of the frame and the rotational drive train of the stapling engine, the stack height compensation mechanism operable to enable the stapling engine to compensate for varying stack heights of sheets to be stapled by the powered stapler;

wherein the stack height compensation mechanism includes at least one resilient member coupled to the shaft.

2. The powered stapler of claim 1, wherein the at least one resilient member is adjacent at least one of the apertures, at least one of the opposite ends of the shaft being supported by the at least one resilient member.

3. The powered stapler of claim 1, further comprising a cam coupled to the first gear for rotation therewith.

4. The powered stapler of claim 3, wherein the stack height compensation mechanism allows the cam to move relative to the first gear.

5. The powered stapler of claim 4, wherein the cam is mounted on a second shaft received in an aperture in the first gear, the aperture in the first gear configured to allow the second shaft to move relative to the first gear.

6. The powered stapler of claim 5, wherein the at least one resilient member at least partially supports the second shaft to constrain movement of the second shaft within the aperture in the first gear.

7. The powered stapler of claim 1, wherein the stack height compensation mechanism includes a resilient member supporting each of the opposite ends of the shaft.

8. The powered stapler of claim 7, wherein the movement of the shaft relative to the frame is constrained by the resilient members.

9. The powered stapler of claim 1, wherein the stack height compensation mechanism does not include any linkage containing a spring.

10. A powered stapler comprising:

a staple driving assembly operable to drive a staple, the staple driving assembly including a driven member;

a rotational drive train operable to actuate the driving assembly, the rotational drive train including a motor and a drive member actuated by the motor;

a frame supporting at least a portion of the rotational drive train; and a housing surrounding the staple driving assembly, the rotational drive train, and the frame;

wherein the drive member is mounted for rotation with a shaft having opposite ends received in arcuate apertures in the frame such that the shaft is movable with respect to the frame along an arcuate path and the drive member is configured to engage the driven member of the driving assembly, the shaft being movable relative to the frame to enable the staple driving assembly and the rotational drive train to compensate for varying stack heights of sheets to be stapled by the powered stapler;

wherein the ends of the shaft received in the apertures in the frame are also received in resilient members coupled to the frame adjacent the apertures, the movement of the shaft within the apertures being constrained by the resilient members;

wherein the shaft also supports a first gear, and wherein the drive member is a cam coupled to the first gear, and wherein the rotational drive train further includes a second gear configured to intermesh with the first gear supported on the shaft, and wherein the apertures in the frame are configured such that the gears will remain in a substantially unchanged intermeshing relation regardless of any movement of the shaft within the apertures in the frame.

11. The powered stapler of claim 10, wherein the resilient members are resilient bushings supported in bushing blocks coupled to the frame.

12. The powered stapler of claim 10, wherein the drive member includes a pair of cams coupled to the first gear.

13. A powered stapler comprising:

a staple driving assembly operable to drive a staple, the staple driving assembly including a driven member; and a rotational drive train operable to actuate the driving assembly, the rotational drive train including a motor and a drive member actuated by the motor;

wherein the drive member is mounted for rotation with a shaft and is configured to engage the driven member of the driving assembly, the shaft being supported by a stack height compensation system that allows movement of the shaft to compensate for varying stack heights of sheets to be stapled by the powered stapler, yet restricts movement of the shaft that would otherwise cause a change in an engagement relationship between components of the rotational drive train that cause rotation of the shaft;

wherein the shaft has opposite ends received in arcuate apertures in a support structure, the opposite ends of the shaft being movable alone an arcuate path within the apertures;

wherein the ends of the shaft received in the apertures are also received in resilient members coupled to the support structure adjacent the apertures, the movement of the shaft within the apertures being constrained by the resilient members wherein the shaft also supports a first gear, and wherein the drive member is a cam coupled to the first gear; and wherein the drive train further includes a second gear configured to intermesh with the first gear supported on the shaft, and wherein the apertures in the support structure are configured such that the gears will remain in a substantially unchanged intermeshing relation reaardless of any movement of the shaft within the apertures.

* * * * *